United States Patent [19]

Mu-Jung

[11] Patent Number: 4,458,826

[45] Date of Patent: Jul. 10, 1984

[54] CASE STRUCTURE

[76] Inventor: Cheng Mu-Jung, No. 16, Fu Chou St., Pin Tong, Taiwan

[21] Appl. No.: 424,234

[22] Filed: Sep. 27, 1982

[51] Int. Cl.[3] ..... B65D 43/14

[52] U.S. Cl. ..... 220/337; 220/338

[58] Field of Search ..... 220/331, 337, 338, 252; 49/104; 16/328, 342, 345; 206/467, 470

[56] References Cited

U.S. PATENT DOCUMENTS

| | | | |
|---|---|---|---|
| 572,217 | 12/1896 | Rebmann | 220/337 |
| 1,439,842 | 12/1922 | Rounsefell | 220/337 |
| 1,647,602 | 11/1927 | Bogle | 220/337 |
| 2,080,786 | 5/1937 | Robles | 220/252 |
| 2,685,983 | 8/1954 | Kelley | 220/331 X |
| 2,765,949 | 10/1956 | Hillman | 220/338 |
| 2,867,348 | 1/1959 | Morrison | 220/331 |
| 4,238,049 | 12/1980 | Lehmann et al. | 220/331 |
| 4,260,069 | 4/1981 | Juergens | 220/331 |

FOREIGN PATENT DOCUMENTS

| | | | |
|---|---|---|---|
| 970459 | 7/1975 | Canada | 220/331 |
| 973017 | 11/1959 | Fed. Rep. of Germany | 220/331 |
| 415852 | 11/1946 | Italy | 220/331 |
| 452098 | 4/1949 | Italy | 220/337 |
| 162680 | 3/1958 | Switzerland | 220/337 |
| 780228 | 7/1957 | United Kingdom | 220/337 |
| 781947 | 8/1957 | United Kingdom | 220/337 |
| 1219886 | 1/1971 | United Kingdom | 220/331 |

*Primary Examiner*—Allan N. Shoap
*Assistant Examiner*—Robert Petrik
*Attorney, Agent, or Firm*—Larson & Taylor

[57] ABSTRACT

A case includes a case body and two slidable and rotatable case covers. The case body is provided with two ring recesses and two guide slots at each end of its two outer side walls. Each cover is provided with two locating pins which are located on the inner walls thereof and are positionable and movable in corresponding ring recesses. Also located on the inner walls of each case cover are two projecting pins located above the corresponding locating pin and insertable into the guide slot of the case body when the case cover is closed.

2 Claims, 11 Drawing Figures

CASE STRUCTURE

BACKGROUND OF THE INVENTION

A case is commonly used for containing things. Conventional cases are of two types. One type has a separate case body and case cover. The other type has the cover connected by ordinary means for movement on the body. However, the former case has been found to suffer from the case cover falling down on the ground if opened carelessly. The latter case has been found to suffer from the need to use two hands when opening the case cover. This is inconvenient when one desires to hold things with one hand, and to use the other to take things out of the case.

Having reviewed the above-mentioned disadvantages in conventional cases, the present invention is disclosed below with the improvements in a case which comprises one embodiment of the present invention.

BRIEF DESCRIPTION OF THE DRAWINGS

The present invention may be described with greater clarity and specificity with reference to the following drawings.

DESCRIPTION OF THE PREFERRED EMBODIMENTS

Figure 1:
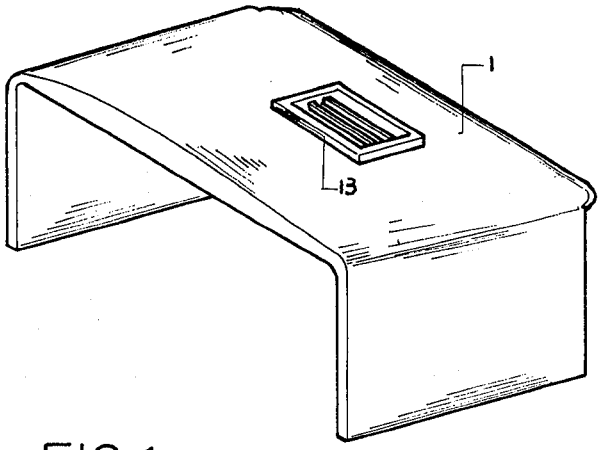
FIG. 1 is a perspective view of the case cover.
Figure 3:
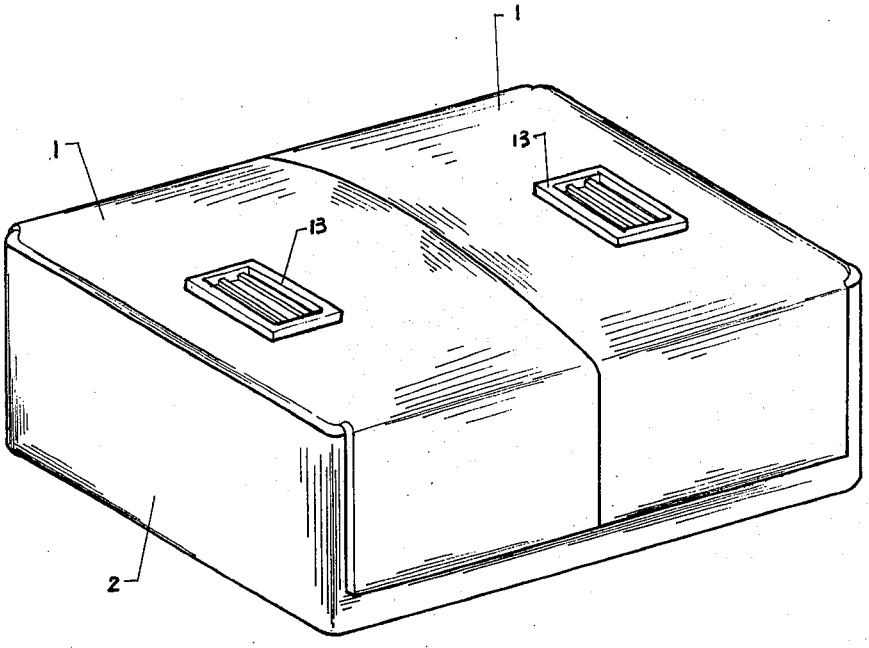
FIG. 3 is a perspective view of the present invention shown with the cover in the closed position after being assembled.
Figure 4:
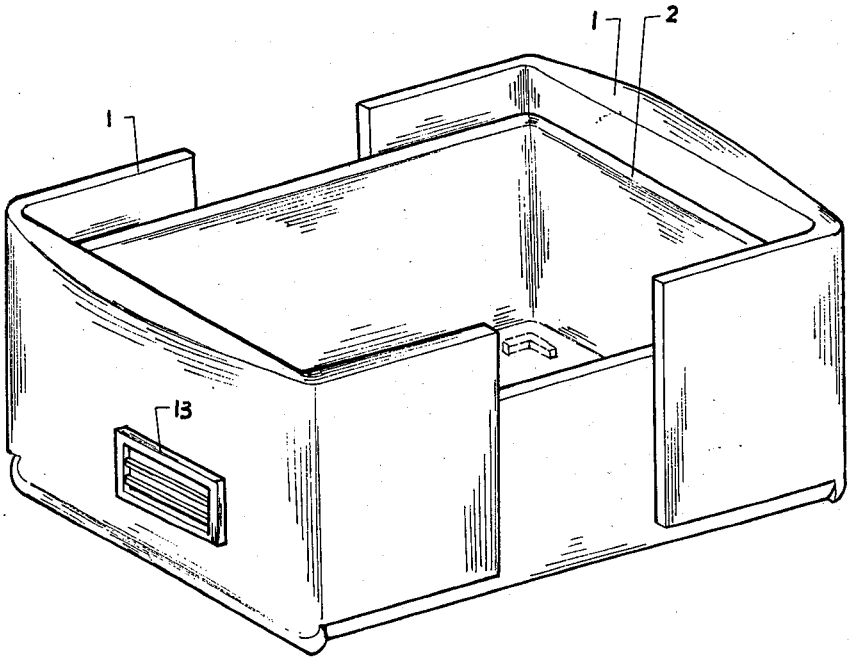
FIG. 4 is a perspective view of the present invention with the cover shown in the open position.
Figure 5:
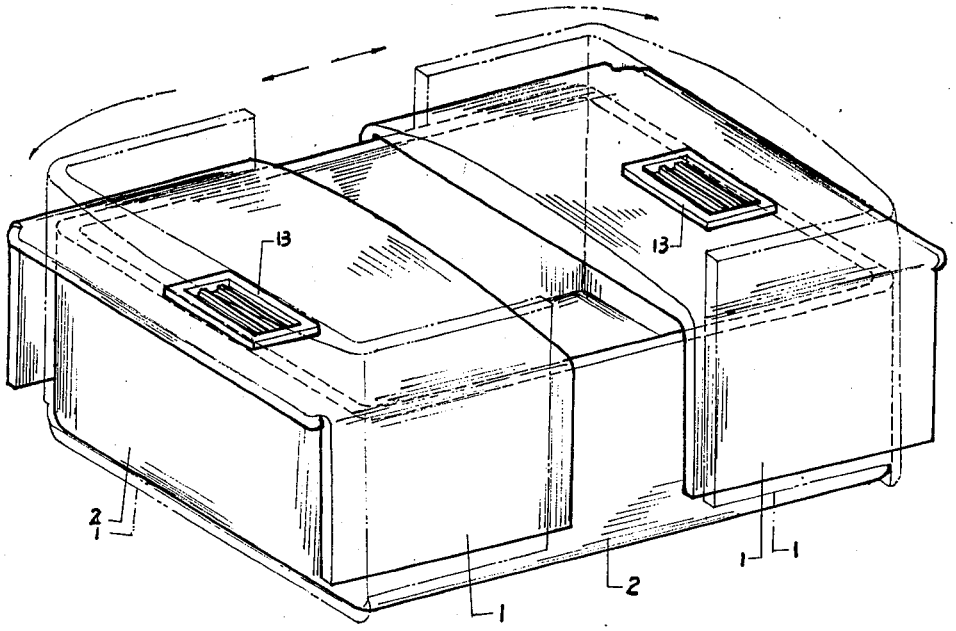
FIG. 5 is a perspective view of the present invention with the cover shown in an intermediate position.
Figure 6:
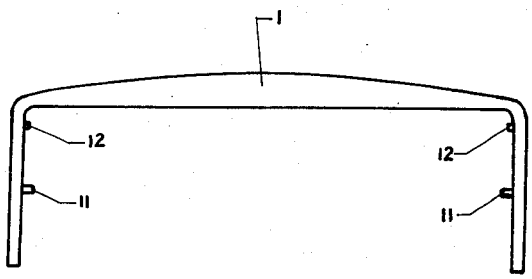
FIG. 6 is a front elevational view of the case cover.
Figure 7:
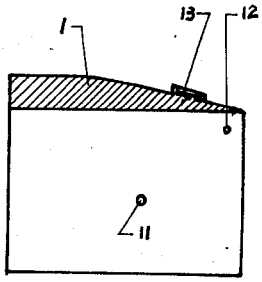
FIG. 7 is a cross-sectional view of Figure 6 taken along a section line.
Figure 8:
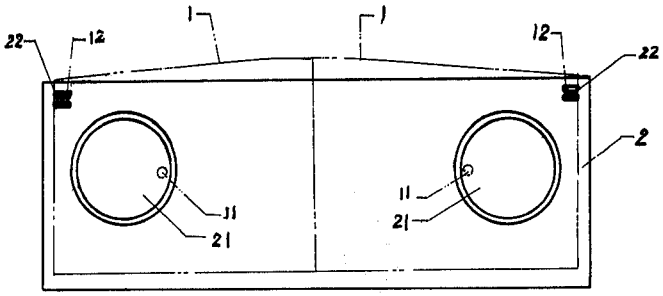
FIG. 8 is a schematic view of the present invention showing the cover in the closed position.

Noting FIG. 3, a case is depicted which comprises a case cover 1 and a case body 2. Noting FIGS. 1, 6 and 7, the case cover 1 includes two U-shaped covers having two locating pins 11 and two projecting pins 12 at its inner walls. At the top surface of the case cover 1 there is provided saw-shaped flanges 13 used to prevent slippage while opening the case cover.

Figure 2:
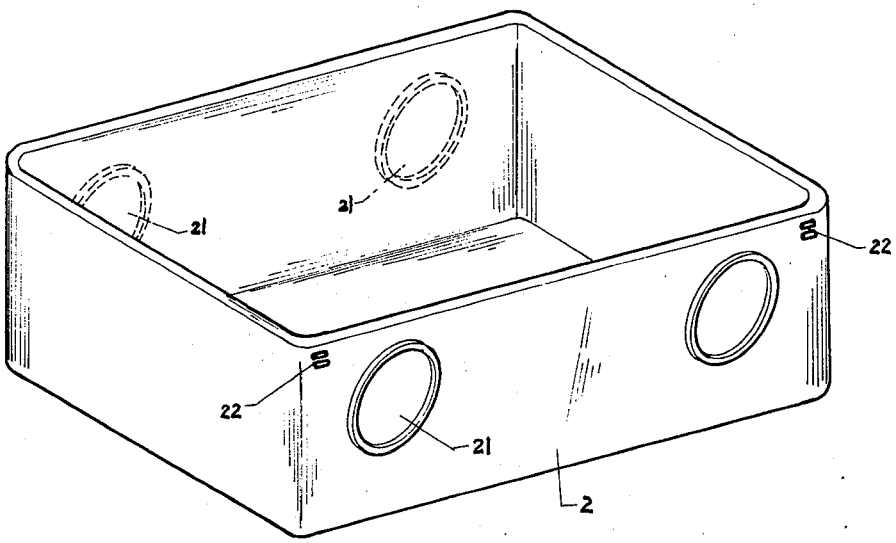
FIG. 2 is a perspective view of the case body.

Referring to FIG. 2, the case body 2 is a container, provided with two ring recesses 21 and guide slot 22 at each end of its side outer walls for insertion thereinto of corresponding locating pins 11 and projecting pins 12, respectively.

Figure 9:
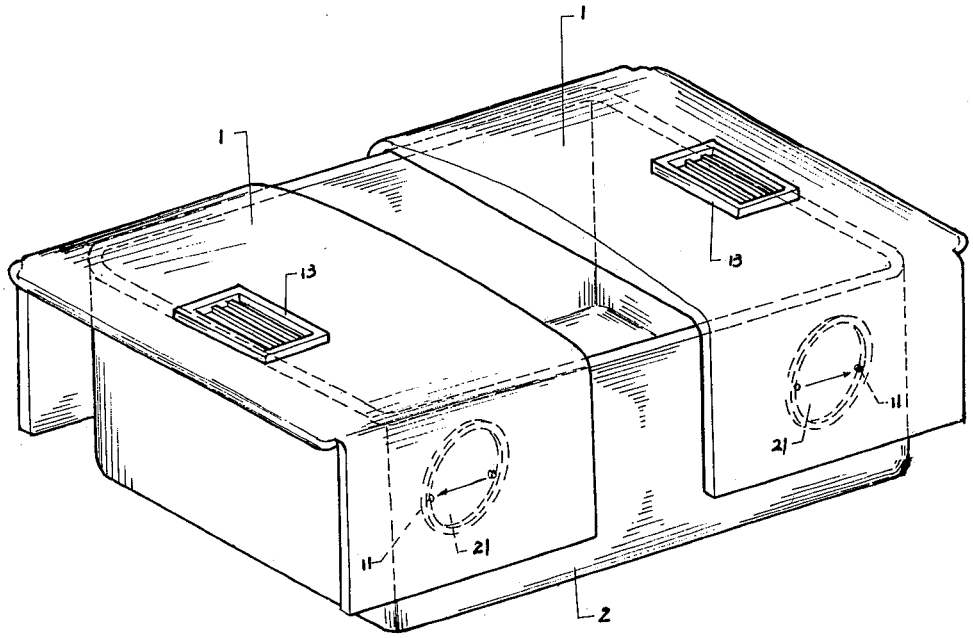
FIG. 9 is a perspective view showing in schematic a first position in the opening process of the present invention.
Figure 10:
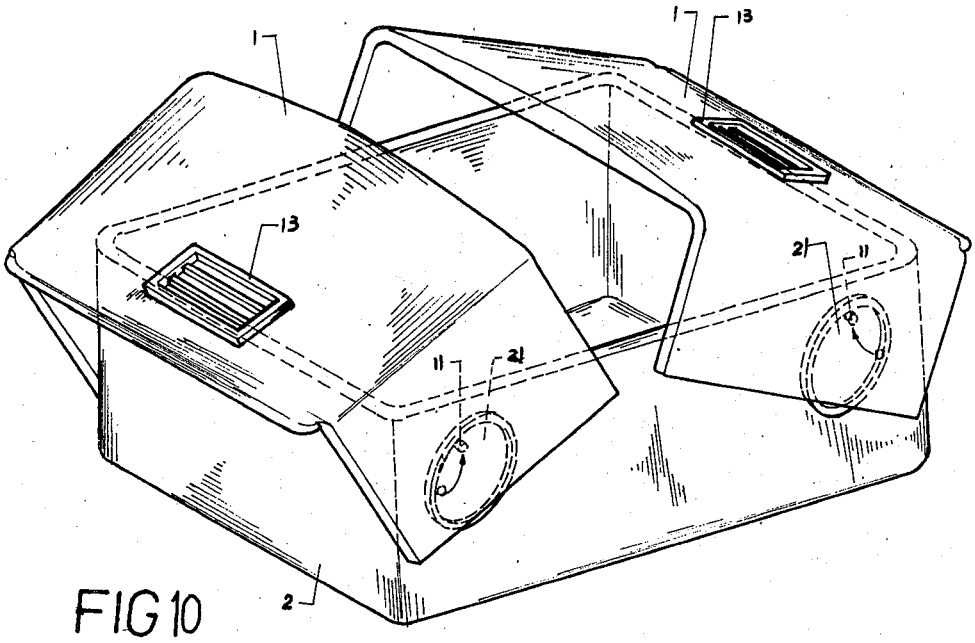
FIG. 10 is a perspective view showing in schematic a second position in the opening process of the present invention.
Figure 11:
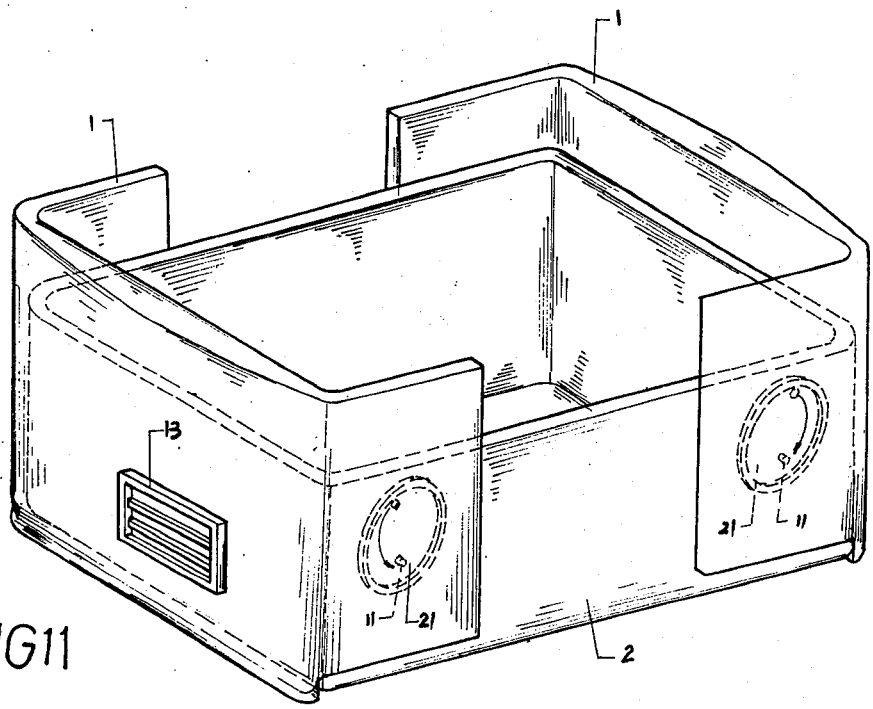
FIG. 11 is a perspective view showing in schematic a third position in the opening process of the present invention.

When it is desired to open case cover 1, one merely places one hand on the saw-shaped flange 13 of case cover 1 and then forces it to the outside (see FIG. 9). As case cover 1 is slid outwardly, projecting pins 12 will escape the guide slot 22 and then the locating pins 11 will move along the inner walls of ring recesses 21 to hold the case cover 1 in the open position (see FIGS. 10 and 11). When it is desired to close the case cover 1, the reverse operation is used.

I claim:

1. A case comprising a body having upstanding sides that define an inner area and that are provided with corresponding recesses in the outer side portions thereof at each end portion therof, each recess being defined by a ring mounted to said body sides and said recesses on corresponding body end portions being in an opposed relationship to each other, each said ring having an inner arcuate wall portion; and first and second covers, each cover mounted at a corresponding end portion of said body and having depending sides with a generally inverted U-shaped cross-section and cylindrical pins located on the inner side portions opposite each other in a central portion of said sides with respect to the top and sides thereof and being received by said recesses, the width of said recesses and of said pins being selected such that said pin has both translational and rotational freedom of movement inside said recess, wherein each pin has a much smaller diameter than the corresponding recess so that said pin can traverse said recess and then engage and follow said ring inner arcuate wall when said cover is opened.

2. The case as claimed in claim 1 and further including two inwardly extending bosses located on the inner side portions, respectively, of each cover above the corresponding said pin and near the corresponding end of said sides; and four guide channels, one guide channel located at each end portion of said body on each side thereof near the corresponding top end corners of said sides, said guide channels and said bosses being located such that said bosses can be inserted into said guide channels when said covers are in the closed position.

* * * * *